US009884494B2

(12) United States Patent
Oe

(10) Patent No.: US 9,884,494 B2
(45) Date of Patent: Feb. 6, 2018

(54) INKJET PRINTING MACHINE

(71) Applicant: RISO KAGAKU CORPORATION, Tokyo (JP)

(72) Inventor: Tomohisa Oe, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/940,795

(22) Filed: Nov. 13, 2015

(65) Prior Publication Data

US 2016/0152053 A1 Jun. 2, 2016

(30) Foreign Application Priority Data

Nov. 28, 2014 (JP) ..... 2014-241105

(51) Int. Cl.
*B41J 11/00* (2006.01)
*B41J 13/08* (2006.01)

(52) U.S. Cl.
CPC ..... *B41J 11/0085* (2013.01); *B41J 11/007* (2013.01); *B41J 13/08* (2013.01)

(58) Field of Classification Search
CPC .... B41J 11/0085; B41J 11/0007; B41J 13/08; B41J 15/00; B41J 15/048
See application file for complete search history.

(56) References Cited

U.S. PATENT DOCUMENTS

2010/0091056 A1* 4/2010 Miyagi ..... B41J 2/16526 347/9
2010/0238249 A1* 9/2010 Panides ..... B41J 11/007 347/104
2014/0184715 A1* 7/2014 Satake ..... B41J 11/0085 347/104
2014/0210155 A1* 7/2014 Satake ..... B41J 11/007 271/11

FOREIGN PATENT DOCUMENTS

JP 2007-031007 2/2007

* cited by examiner

*Primary Examiner* — Sharon A Polk
(74) *Attorney, Agent, or Firm* — Greenblum & Bernstein, P.L.C.

(57) ABSTRACT

An inkjet printing machine includes: a paper feeder; a transfer unit having a conveyer belt with a plurality of suction holes formed thereon and transferring a sheet fed by the paper feeder while sucking and holding the sheet on the conveyer belt by suction force generated at the suction holes; inkjet heads discharging ink on the transferred sheet; and a controller performing printing by controlling the above components, wherein the suction holes of the conveyer belt are arranged so that, when the leading edge of the sheet in the transfer direction does not overlap with the suction holes, the trailing edge of the sheet also does not overlap with the suction holes, and the controller controls the paper feeder to feed a sheet at a timing when the leading edge and the trailing edge of the sheet in the transfer direction do not overlap with the suction holes.

4 Claims, 7 Drawing Sheets

INKJET PRINTING MACHINE

BACKGROUND

1. Technical Field

The present invention relates to an inkjet printing machine configured to discharge ink from inkjet heads to perform printing.

2. Related Art

There is known a line-type inkjet printing machine configured to perform printing by discharging ink from fixed inkjet heads onto a sheet, while transferring the sheet. A so-called air suction transfer mechanism to transfer sheets is widely used in the line-type inkjet printing machine (see, for example, Japanese Patent Application Laid-Open Publication No. 2007-31007).

The air suction transfer mechanism sucks air with a fan through a large number of suction holes provided on a conveyer belt, and sucks and holds a sheet on the conveyer belt by suction force caused by negative pressure generated at the suction holes. The conveyer belt moves while thus sucking and holding a sheet to transfer the sheet.

SUMMARY

Problems to be Solved by the Invention

In an inkjet printing machine using an air suction transfer mechanism, a portion of ink mist generated by discharging of ink is carried on an airflow caused by air suction toward the suction holes. Therefore, adhering of the carried ink mist to a sheet on the conveyer belt may stain the sheet.

The present invention has been made in view of the above problem. An object of the present invention is to provide an inkjet printing machine which can reduce the staining of sheets.

Means to Solve the Problem

In order to achieve the aforementioned object, a first feature of the inkjet printing machine according to the present invention includes: a paper feeder configured to feed a sheet; a transfer unit having a conveyer belt with a plurality of suction holes formed thereon and configured to transfer a sheet fed by the paper feeder while sucking and holding the sheet on the conveyer belt by suction force which is generated at the suction holes; inkjet heads configured to discharge ink on a sheet being transferred by the transfer unit; and a controller configured to perform printing by controlling the paper feeder to feed a sheet, controlling the transfer unit to transfer the fed sheet, and controlling the inkjet heads to discharge ink on the sheet, wherein the plurality of suction holes of the conveyer belt is arranged, when the leading edge of the sheet in the transfer direction does not overlap with the suction holes, the trailing edge of the sheet also does not overlap with the suction holes, and the controller controls the paper feeder to feed at a timing when the leading edge and the trailing edge of the sheet in the transfer direction do not overlap with the suction holes.

A second feature of the inkjet printing machine according to the present invention lies in that the plurality of suction holes of the conveyer belt is arranged so that an edge of the sheet in a sheet-width direction perpendicular to the transfer direction does not overlap with the suction holes.

BRIEF DESCRIPTION OF DRAWINGS

The invention will now be described with reference to the accompanying drawings wherein.

DETAILED DESCRIPTION

The embodiments of the present invention will be described with reference to the drawings. Throughout the drawings, identical or equivalent parts or components are provided with identical or equivalent symbols.

The embodiment described below exemplifies devices or the like for realizing the technical idea of the invention, the technical idea of the invention not being intended to limit the material, shape, structure, arrangement, or the like, of each component to those described in the following. The technical idea of the invention may be modified in various ways within the scope of claims.

Figure 1:
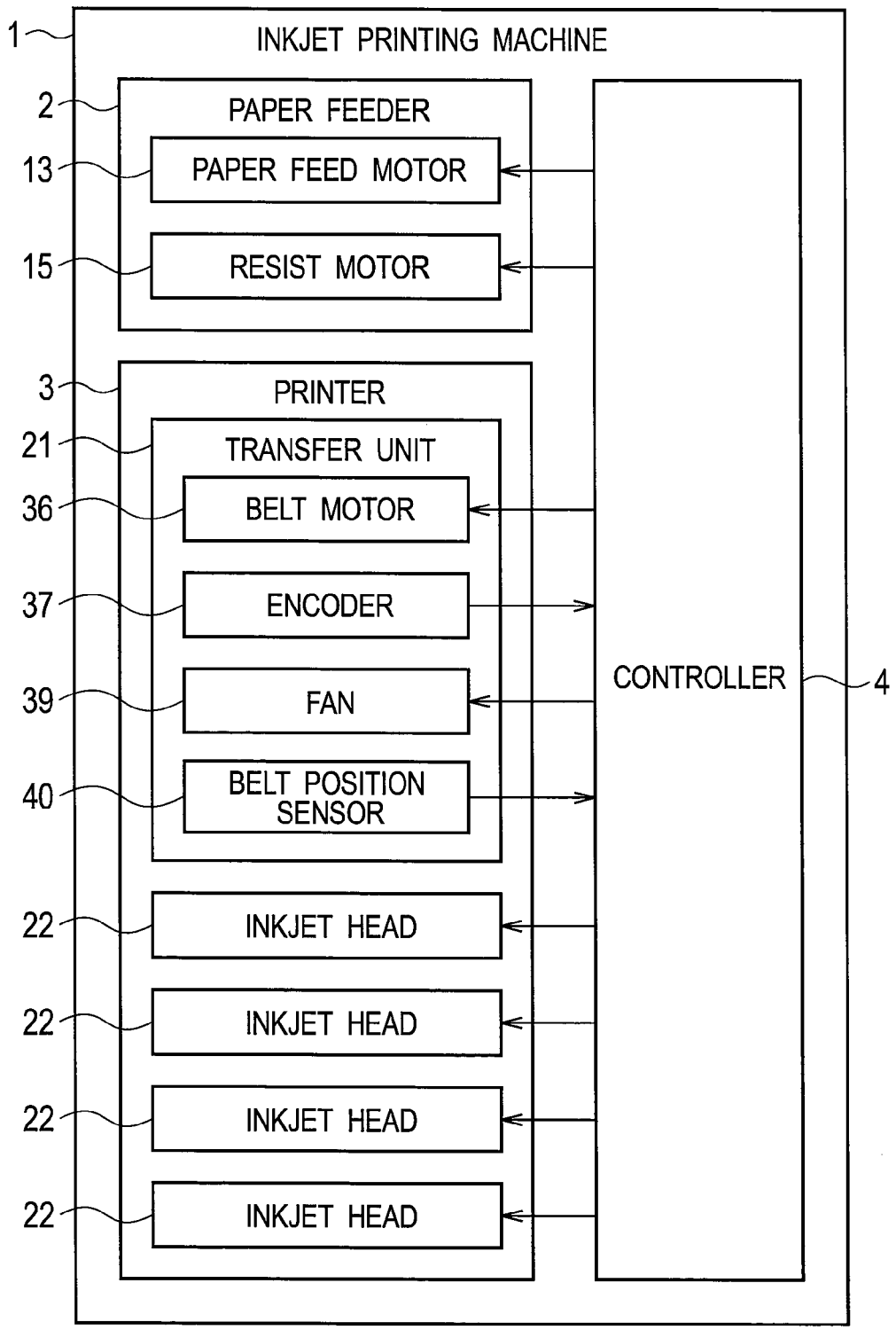
FIG. 1 is a block diagram illustrating a configuration of an inkjet printing machine according to an embodiment.
Figure 2:
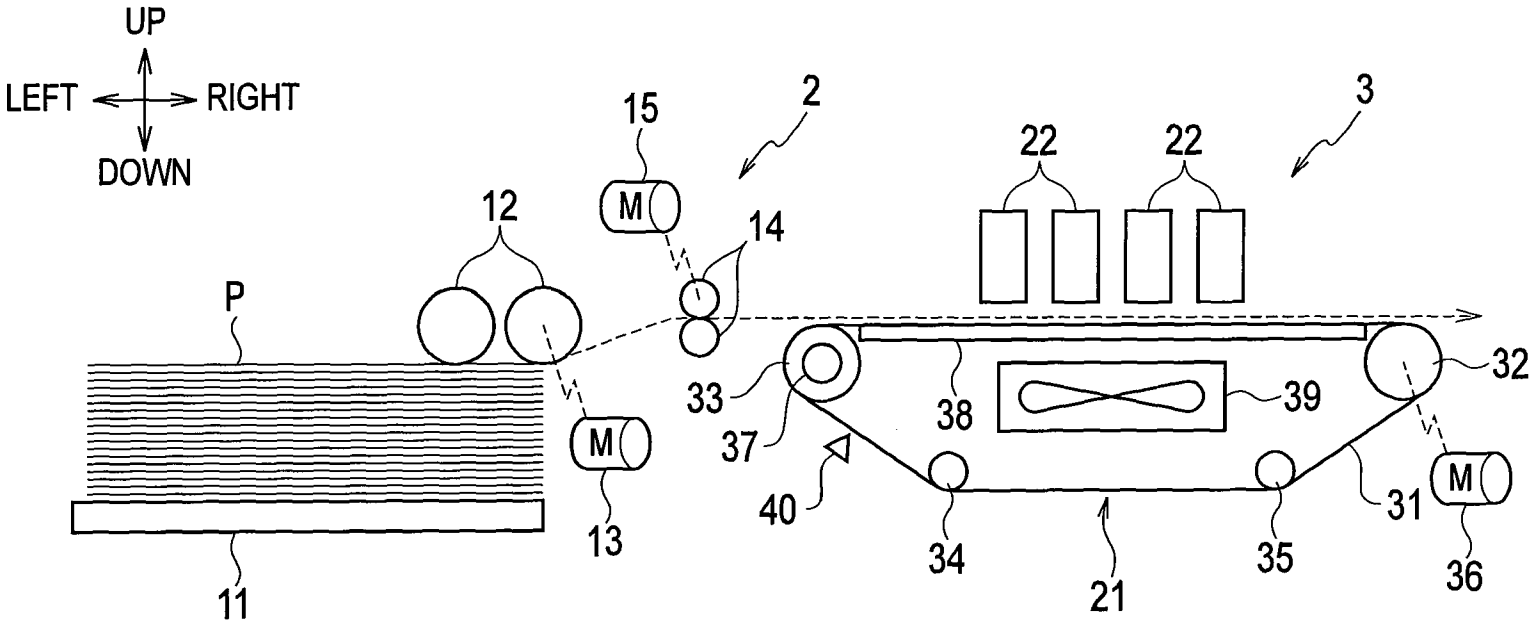
FIG. 2 is an outline configuration diagram of a paper feeder and a printer of the inkjet printing machine illustrated in FIG. 1.
Figure 3:
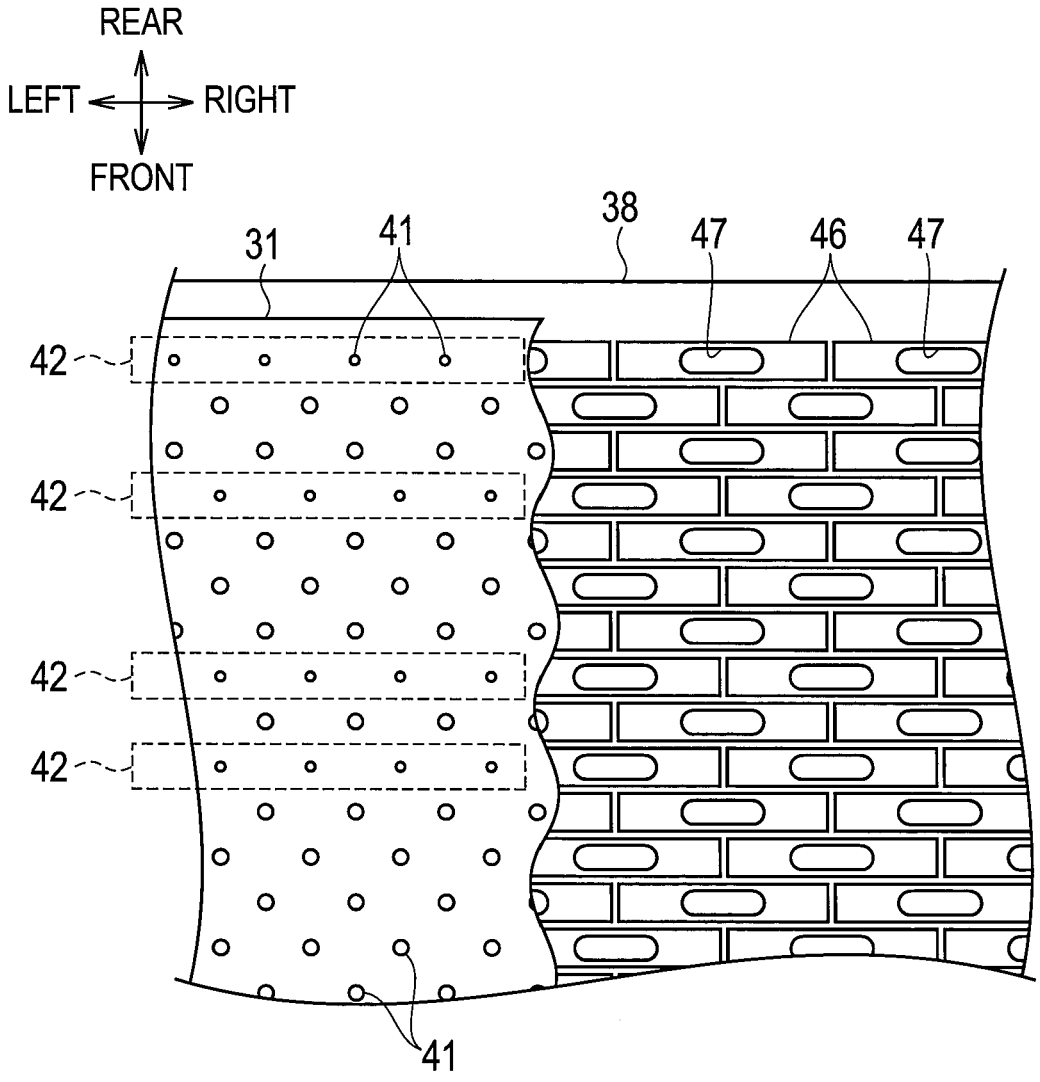
FIG. 3 is a partial enlarged plan view of a conveyer belt and a platen plate of the printer illustrated in FIG. 2.

FIG. 1 is a block diagram illustrating a configuration of an inkjet printing machine according to an embodiment of the present invention. FIG. 2 is an outline configuration diagram of a paper feeder and a printer of the inkjet printing machine illustrated in FIG. 1. FIG. 3 is a partial enlarged plan view of a conveyer belt and a platen plate of the printer illustrated in FIG. 2.

In the following description, a direction perpendicular to the plane of FIG. 2 is assumed to be a forward-backward direction with a front side of the plane indicating a forward direction, unless otherwise stated. In addition, an up-down and a right-left directions in the plane of FIG. 2 are assumed to be a vertical and a horizontal directions respectively. In FIG. 2, the direction from the left to the right is the transfer direction of sheets P which are the print media. The upstream and the downstream which appear in the following description indicate the upstream and the downstream in the transfer direction.

As illustrated in FIG. 1, an inkjet printing machine 1 according to the embodiment includes a paper feeder 2, a printer 3, and a controller 4.

The paper feeder 2 feeds the sheets P to the printer 3. As illustrated in FIG. 2, the paper feeder 2 includes a paper feed tray 11, a paper feed roller 12, a paper feed motor 13, a resist roller 14, and a resist motor 15.

The paper feed tray 11 is loaded with the sheets P to be used for printing.

The paper feed roller 12 performs primary paper feeding. The primary paper feeding feeds sheets from the paper feed tray 11 to the resist roller 14. Specifically, the paper feed roller 12 picks up the sheet P one by one from the paper feed tray 11 and transfers it, then the paper feed roller 12 makes the sheet P butt against the sheet P against the resist roller 14 and stops the sheet P.

The paper feed motor 13 rotationally activates the paper feed roller 12.

The resist roller 14 performs secondary paper feeding. The secondary paper feeding feeds sheets from the resist roller 14 to the printer 3. Specifically, the resist roller 14 temporarily stops the sheet P which has been transferred by the paper feed roller 12 and subsequently transfers the sheet P toward the printer 3. The resist roller 14 is provided on the downstream side of the paper feed roller 12.

The resist motor 15 rotationally activates the resist roller 14.

The printer 3 performs printing while transferring the sheet P. The printer 3 is provided on the downstream side of the paper feeder 2. The printer 3 includes a transfer unit 21 and four inkjet heads 22.

The transfer unit 21 transfers the sheet P fed by the paper feeder 2. The transfer unit 21 includes a conveyer belt 31, a drive roller 32, driven rollers 33, 34 and 35, a belt motor 36, an encoder 37, a platen plate 38, a fan 39, and a belt position sensor 40.

The conveyer belt 31 transfers the sheet P while sucking and holding it. The conveyer belt 31 is a looped belt stretched across the drive roller 32 and the driven rollers 33 to 35. The conveyer belt 31, having plasticity, is made of a material such as rubber, resin, or the like which generates a suitable frictional force against the sheet P.

As illustrated in FIG. 3, the conveyer belt 31 is formed with a plurality of suction holes 41. The conveyer belt 31 sucks and holds on its top surface the sheet P by suction force which is generated at the suction holes 41 by driving of the fan 39. The conveyer belt 31 rotates in the clockwise direction to transfer the sucked and held sheet P rightward, as illustrated in FIG. 2.

The suction holes 41 are arranged in the transfer direction (right-left direction) with a predetermined pitch. In addition, the suction holes 41 of the next stage adjacent in the sheet-width direction (forward-backward direction) perpendicular to the transfer direction are arranged in a manner displaced relative to the suction holes 41 of the preceding stage by as much as a half pitch in the transfer direction. In other words, the suction holes 41 are arranged in a staggered manner.

The suction holes 41 are arranged so that, when the leading edge of the sheet P in the transfer direction does not overlap with the suction holes 41, the trailing edge of the sheet P also does not overlap with the suction holes 41, the sheet P of various standard sizes which are used in the inkjet printing machine 1.

In addition, the suction holes 41 are arranged so that the edge of the sheet P in the sheet-width direction does not overlap with the suction holes 41, the sheet P of various standard sizes used in the inkjet printing machine 1. Here, the position in the sheet-width direction of the sheet P on the conveyer belt 31 corresponds to the position in the sheet-width direction of the sheet P on the paper feed tray 11. On the paper feed tray 11, the sheet P is loaded in a manner positioned in the sheet-width direction.

In addition, among the suction holes 41 of the conveyer belt 31, those located in a region adjacent to the edge in the sheet-width direction of the sheet P are formed to be smaller than the other suction holes 41. Specifically, the suction holes 41 which are adjacent to the outside of the sheet P with respect to one or the other edge in the sheet-width direction of the sheet P of various standard sizes which are used in the inkjet printing machine 1 are formed to be smaller than the other suction holes 41.

Here, a "region adjacent to the edge" refers to a region located within a predetermined distance in the sheet-width direction from the edge in the sheet-width direction of the sheet P. The predetermined distance is approximately equal to the interval of the arrangement of the sheet-width direction of the suction holes 41 which are arranged in a staggered manner. In other words, when the suction holes 41 are adjacent to the outside of the sheet P, the distance from the suction holes 41 to the edge in the sheet-width direction of the sheet P becomes shorter than the interval of the arrangement of the suction holes 41 in the sheet-width direction.

Giving a full detail of the suction holes 41, a small-diameter suction holes column 42 is formed on the conveyer belt 31, as illustrated in FIG. 3. The small-diameter suction holes column 42 is configured to arrange the suction holes 41 having a smaller diameter than the suction holes 41 at other positions in the transfer direction. The four columns of small-diameter suction holes 42 in FIG. 3 are each adjacent to one of the edges in the sheet-width direction of the sheet P of four types of standard sizes. A plurality of columns of small-diameter suction holes 42 may be provided to each edge in the sheet-width direction of the sheet P of each size.

The drive roller 32 rotates the conveyer belt 31 in the clockwise direction in FIG. 2. In other words, operation of the drive roller 32 causes the conveyer belt 31 to proceed over the upper side of the platen plate 38 in the transfer direction.

The driven rollers 33 to 35 support the conveyer belt 31 together with the drive roller 32. The driven rollers 33 to 35 follow the movement of the drive roller 32 via the conveyer belt 31. The driven roller 33 is provided on the left side of the drive roller 32 at the same height as the drive roller 32. The driven rollers 34 and 35 are provided at the same height under the drive roller 32 and the driven roller 33 in a manner separated rightward and leftward from each other.

The belt motor 36 rotationally activates the drive roller 32.

The encoder 37 outputs a pulse signal at each predetermined rotation angle of the driven roller 33.

The platen plate 38, which is arranged under the conveyer belt 31 and between the drive roller 32 and driven roller 33, supports the back side of the conveyer belt 31 in a slidable manner. The platen plate 38 is made of metal, resin, or the like. The platen plate 38 has a plurality of concave portions 46 which is dented from the upper surface to the lower surface at a position where the suction holes 41 pass, and a plurality of through-holes 47 which penetrates from a part of the bottom surface of the concave portion 46 to the lower surface of the platen plate 38.

The fan 39 generates a downward airflow. Accordingly, the fan 39 sucks air via the through-hole 47 of the platen plate 38, the concave portion 46, and the suction holes 41 of the conveyer belt 31 to generate negative pressure in the suction holes 41, and sucks the sheet P on the conveyer belt 31. The fan 39 is provided under the platen plate 38.

The belt position sensor 40 detects a reference hole 61 formed on the conveyor belt 31.

The inkjet heads 22 discharge ink onto the sheet P which is transferred by the transfer unit 21 to print an image thereon. The four inkjet heads 22 discharge four colors of ink: black, cyan, magenta and yellow, respectively. The inkjet heads 22 are arranged above the transfer unit 21.

The controller 4 controls operation of each part of the inkjet printing machine 1. The controller 4 is configured to include a CPU, a RAM, a ROM, a hard disk, or the like.

Specifically, the controller 4 performs control so that the paper feeder 2 feeds the sheet P and, while the transfer unit 21 transfers the sheet P, the inkjet heads 22 discharge the ink to perform printing on the sheet P. Here, the controller 4 controls the paper feeder 2 to feed a sheet at a timing when the leading edge and the trailing edge of the sheet P in the transfer direction do not overlap with the suction holes 41.

Next, an operation of the inkjet printing machine 1 will be described.

Figure 4:
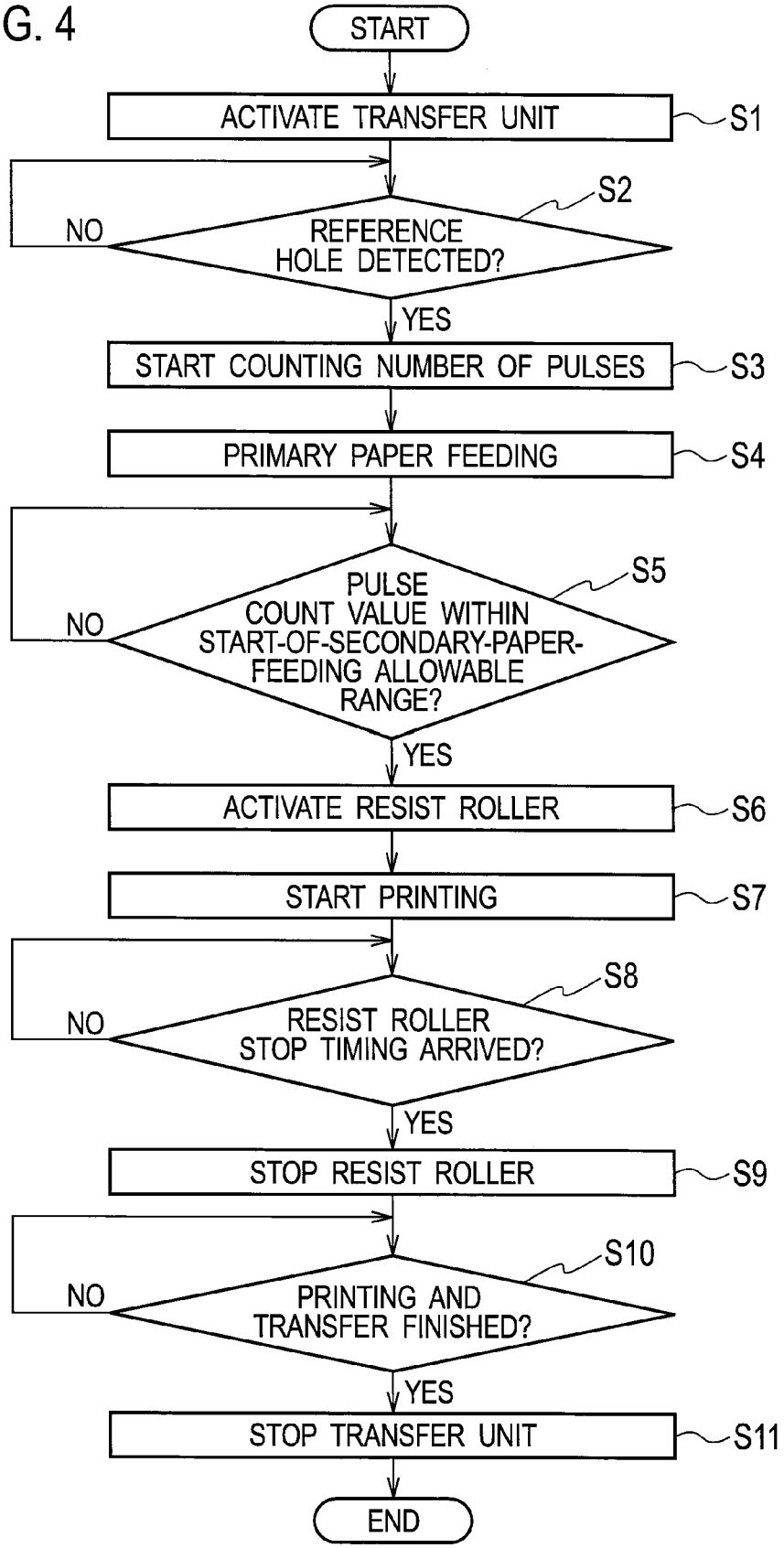
FIG. 4 is a flowchart for explaining an operation of the inkjet printing machine illustrated in FIG. 1.

FIG. 4 is a flowchart which explains an operation of the inkjet printing machine 1. Processing of the flowchart of FIG. 4 starts by inputting a print job to the inkjet printing machine 1.

At step S1 of FIG. 4, the controller 4 activates the transfer unit 21. Specifically, the controller 4 activates the drive roller 32 using the belt motor 36. Accordingly, circulation of the conveyer belt 31 is started. The controller 4 drives the drive roller 32 so that the transfer speed of the sheet P by the conveyer belt 31 is adjusted to a predetermined print transfer speed. In addition, the controller 4 activates the fan 39.

Subsequently, the controller 4 determines, at step S2, whether or not the reference hole of the conveyer belt 31 has been detected by the belt position sensor 40. When it is determined that the reference hole has not been detected (NO at step S2), the controller 4 repeats step S2.

When the controller 4 determines that the reference hole has been detected (YES at step S2), the controller 4 starts, at step S3, counting the number of pulses output by the encoder 37.

Subsequently, the controller 4, at step S4, drives the paper feed roller 12 using the paper feed motor 13 to perform a primary paper feeding. Specifically, the controller 4 controls so that, after the paper feed roller 12 has picked up the sheet P from the paper feed tray 11 and the sheet P is butted against the resist roller 14 and the sheet P is stopped by slackening. Accordingly, skew of the sheet P is corrected.

Subsequently, the controller 4 determines, at step S5, whether or not the pulse count value is within a range of values allowing a secondary paper feeding to be started. The start-of-secondary-paper-feeding allowable range is a range of pulse count values corresponding to the start timing of the resist roller 14 at which the leading edge of the sheet P in the transfer direction being transferred to the transfer unit 21 by the resist roller 14 does not overlap with the suction holes 41. The start-of-secondary-paper-feeding allowable range is preliminarily set in accordance with the arrangement of the suction holes 41. When the controller 4 determines that the pulse count value is outside the start-of-secondary-paper-feeding allowable range (NO at step S5), the controller 4 repeats step S5.

When the controller 4 determines that the pulse count value is within the start-of-secondary-paper-feeding allowable range (YES at step S5), the controller 4 activates the resist roller 14 using the resist motor 15 at step S6. Accordingly, the sheet P starts transferring toward the transfer unit 21 using the resist roller 14. The controller 4 controls the resist roller 14 so that the sheet P reaches the conveyer belt 31 at the print transfer speed.

When the leading edge of the sheet P reaches the conveyer belt 31, the sheet P is transferred by the conveyer belt 31 and the resist roller 14 while gradually being sucked to the conveyer belt 31 from the front end side of the sheet P.

Figure 5:
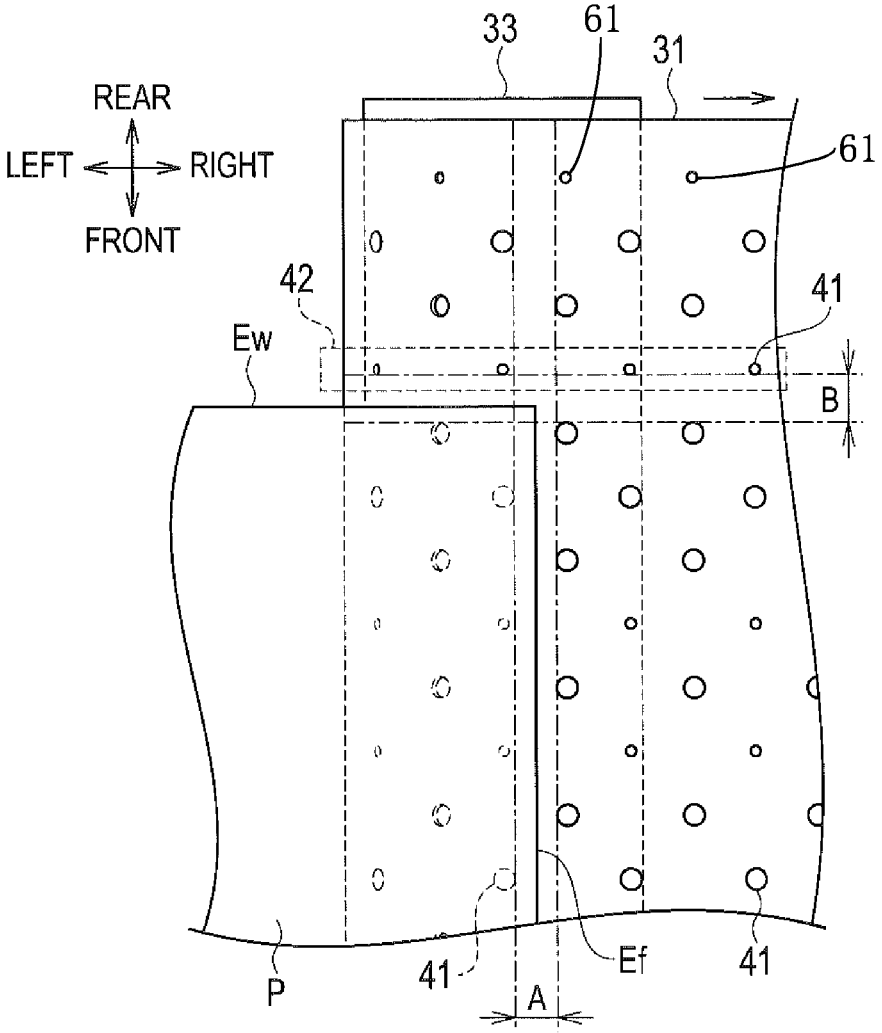
FIG. 5 is an explanatory diagram of a positional relation between a sheet and suction holes of the conveyer belt at the front end portion of the sheet.

Here, the controller 4 activates the resist roller 14 when the pulse count value is within the start-of-secondary-paper-feeding allowable range and therefore the leading edge Ef of the sheet P in the transfer direction does not overlap with the suction holes 41, as illustrated in FIG. 5. In other words, the leading edge Ef of the sheet P is located within a range A in which the suction holes 41 do not exist in the transfer direction of the conveyer belt 31.

In addition, an edge Ew in the sheet-width direction of the sheet P is located within a range B in which the suction holes 41 do not exist in the sheet-width direction of the conveyer belt 31. In addition, the suction holes 41 which are adjacent to the outside of the sheet P with respect to the edge Ew in the sheet-width direction are set to be the suction holes 41 in the small-diameter suction holes column 42. Although the edge Ew of one side of the sheet-width direction is illustrated in FIG. 5, the edge Ew of the other side is arranged in a similar manner.

Referencing again to FIG. 4, the controller 4 starts, at step S7 subsequent to step S6, printing by the inkjet heads 22 after the sheet P has reached a predetermined position under the inkjet heads 22.

Subsequently, the controller 4 determines, at step S8, whether or not a resist roller stop timing has arrived. The resist roller stop timing is a timing at which the trailing edge of the sheet P in the transfer direction leaves the resist roller 14. The resist roller stop timing is set in accordance with the length of the sheet P in the transfer direction. When the controller 4 determines that the resist roller stop timing has not arrived (NO at step S8), the controller 4 repeats step S8.

When the controller 4 determines that the resist roller stop timing has arrived (YES at step S8), the controller 4 stops the resist roller 14 at step S9.

After the trailing edge of the sheet P has left the resist roller 14, the sheet P is subjected to printing while being transferred by the conveyer belt 31 in the printer 3.

Figure 6:
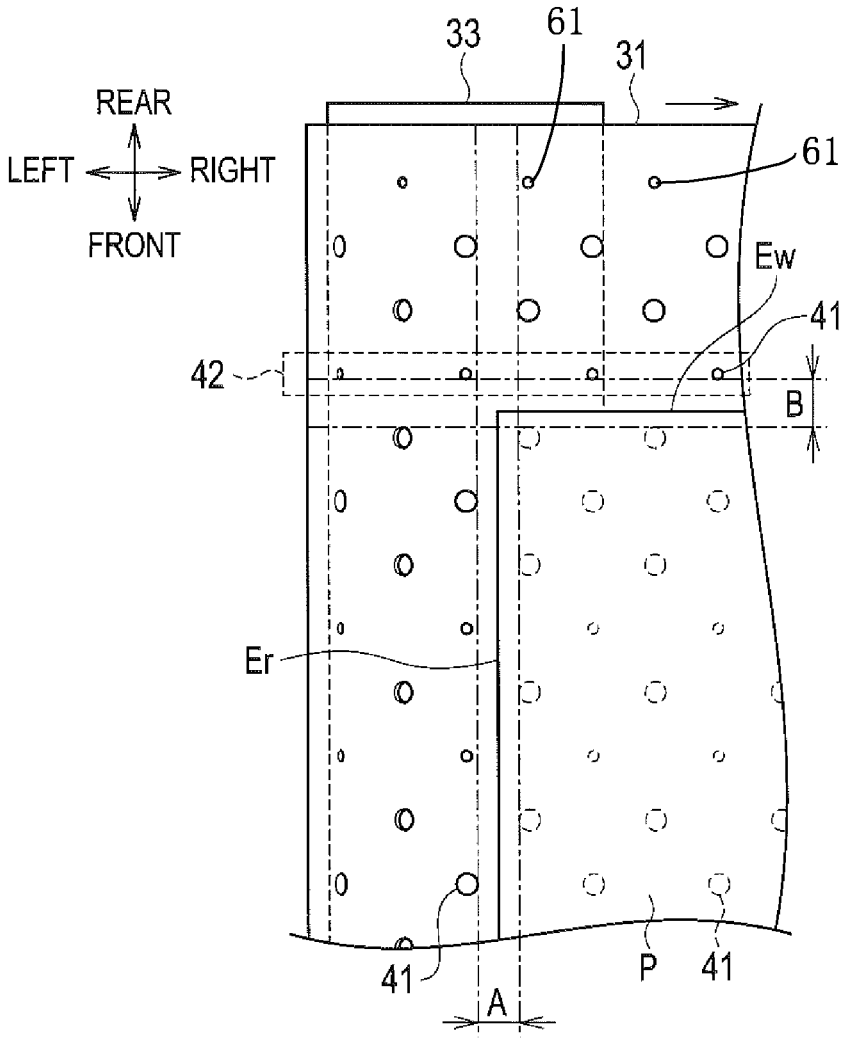
FIG. 6 is an explanatory diagram of a positional relation between a sheet and suction holes of the conveyer belt at the rear end portion of the sheet.

Here, the leading edge Ef of the sheet P in the transfer direction does not overlap with the suction holes 41 and therefore the trailing edge Er also does not overlap with the suction holes 41, as illustrated in FIG. 6. In other words, the trailing edge Er of the sheet P is located within the range A in which the suction holes 41 do not exist in the transfer direction of the conveyer belt 31, as with the leading edge Ef.

Referring again to FIG. 4, the controller 4 determines, at step S10 subsequent to step S9, whether or not printing and transfer of the sheet P in the printer 3 have finished. When the controller 4 determines that printing and transfer have not finished (NO at step S10), the controller 4 repeats step S10.

When the controller 4 determines that printing and transfer have finished (YES at step S10), the controller 4 stops the transfer unit 21 at step S11. Specifically, the controller 4 activates the drive roller 32, as well as stopping the fan 39. Accordingly, the series of operation comes to an end.

As described above, the suction holes 41 of the conveyer belt 31 in the inkjet printing machine 1 are arranged so that, when the leading edge of the sheet P in the transfer direction does not overlap with the suction holes 41, the trailing edge of the sheet P also does not overlap with the suction holes 41. The controller 4 thus controls the paper feeder 2 to feed a sheet at a timing when the leading edge Ef and the trailing edge Er of the sheet P in the transfer direction do not overlap with the suction holes 41.

Accordingly, in the printer 3, the sheet P is subjected to printing with ink discharged from the inkjet heads 22, while being transferred in a state that the leading edge Ef and the trailing edge Er in the transfer direction do not overlap with the suction holes 41.

Figure 7:
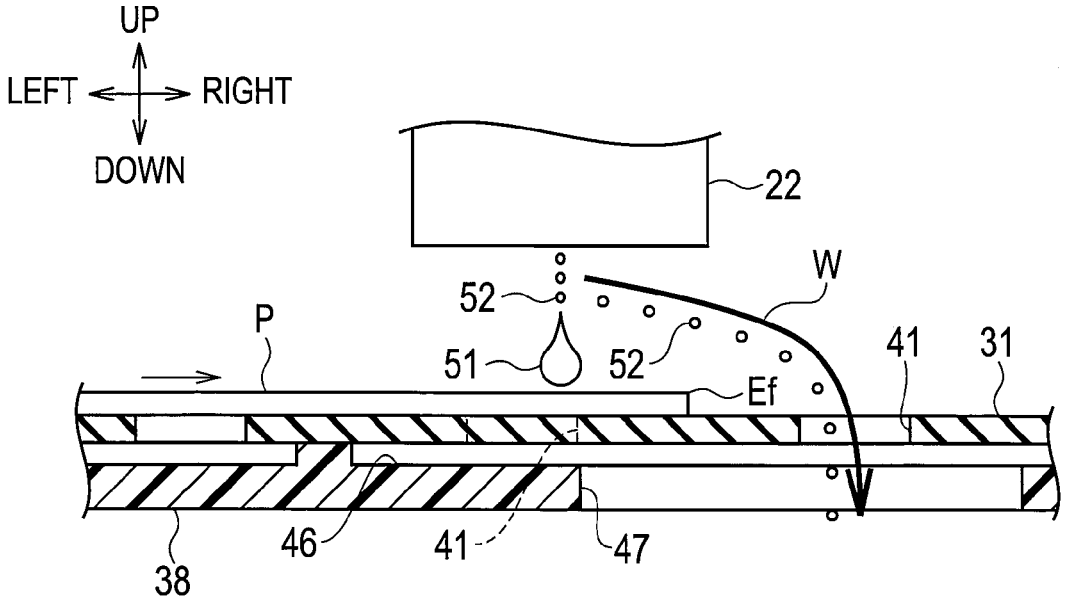
FIG. 7 illustrates a positional relation between the flow of ink mist caused by air suction and the sheet according to the embodiment.

When the ink is discharged from the inkjet head 22, as illustrated in FIG. 7, a main droplet 51 of the ink flies and a fine ink mist 52 is generated. A part of the ink mist 52 is carried away by an airflow W which is caused by air suction toward the suction holes 41.

Figure 8:
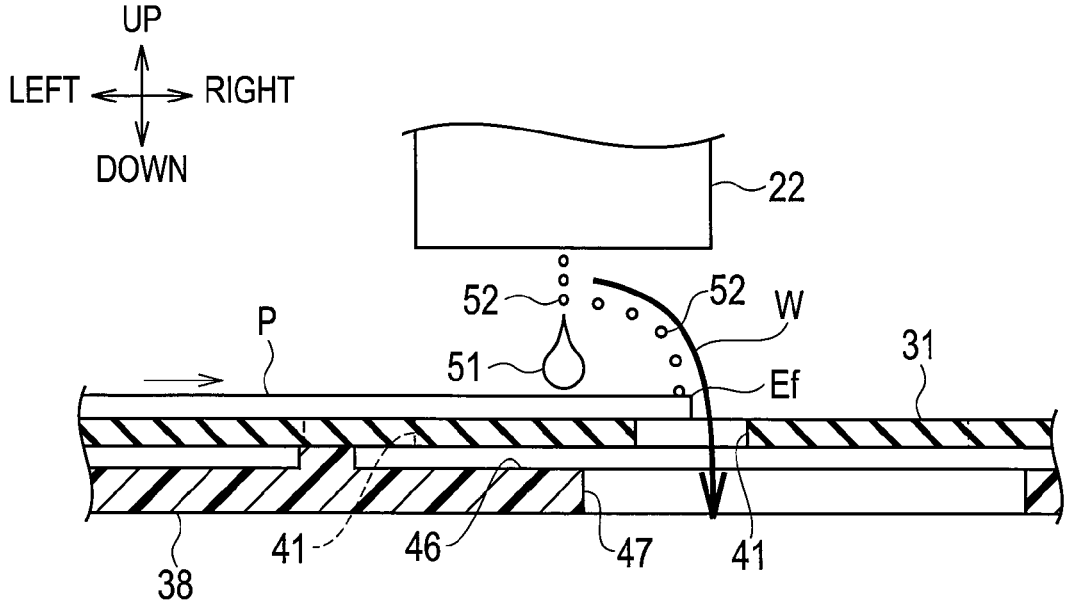
FIG. 8 illustrates a positional relation between the flow of an ink mist caused by air suction and the sheet when the leading edge of the sheet overlaps with the suction holes.

Unlike the present embodiment, if the leading edge Ef of the sheet P overlaps with the suction holes 41, as illustrated in FIG. 8, the ink mist 52 which is carried away by the airflow W tends to adhere to the front end portion of the sheet P. In addition, when the trailing edge Er of the sheet P overlaps with the suction holes 41, the ink mist 52 which is carried away by the airflow W tends to adhere to the rear end portion of the sheet P.

In the inkjet printing machine 1 of the present embodiment, in contrast, the leading edge Ef of the sheet P does not overlap with the suction holes 41, as shown in FIG. 7, and therefore the ink mist 52 is unlikely to adhere to the sheet P even when the ink mist 52 is carried away by the airflow W toward the suction holes 41. Similarly, at the rear end side of the sheet P, the trailing edge Er of the sheet P does not overlap with the suction holes 41 and therefore the ink mist 52 is unlikely to adhere to the sheet P even when the ink mist 52 is carried away toward the suction holes 41 by the airflow W caused by air suction. Accordingly, the amount of the ink mist 52 which may adhere to the front end portion and the rear end portion of the sheet P can be reduced. As a result, the stain on the sheet P can be reduced.

In addition, in the inkjet printing machine 1, the suction holes 41 of the conveyer belt 31 are arranged so that both edges in the sheet-width direction of the sheet P do not overlap with the suction holes 41. Accordingly, it is possible to reduce the amount of the ink mist 52 which may adhere to the edge portion of the sheet P in the sheet-width direction, as with the front end portion and the rear end portion of the sheet P in the transfer direction. As a result, the stain on the sheet P can be further reduced.

In addition, in the inkjet printing machine 1, the suction holes 41 in a region adjacent to an edge of the sheet P in the sheet-width direction are formed to be smaller than the other suction holes 41. Accordingly, the amount of the ink mist 52 which may flow into the suction holes 41 in the region adjacent to the edge of the sheet P in the sheet-width direction can be reduced. It is therefore possible to reduce the amount of the ink mist 52 which may adhere to the edge of the sheet P in the sheet-width direction. As a result, the stain on the sheet P can be further reduced.

The present invention is not limited to the aforementioned embodiment as it is, and may be implemented by modifying the components thereof within a range that does not deviate from its scope. In addition, a variety of inventions can be made by combining as appropriate a plurality of components disclosed in the aforementioned embodiment. For example, some of the components may be deleted from the entirety of components described in the embodiment.

In addition, for example, each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

The present application claims priority based on Japanese Patent Application No. 2014-241105 filed on Nov. 28, 2014, entire content of which is incorporated herein by reference.

INDUSTRIAL APPLICABILITY

According to the present invention, a plurality of suction holes of a conveyer belt is arranged so that, when the leading edge of sheet in the transfer direction does not overlap with the suction holes, the trailing edge of the sheet also does not overlap with the suction holes. A controller controls a paper feeder to feed the sheet at a timing when the leading edge and the trailing edge of the sheet in the transfer direction do not overlap with the suction holes. Accordingly, it is possible to reduce the amount of ink mist which may adhere to the front end portion and the rear end portion of the sheet in the transfer direction. As a result, stain on the sheet can be reduced.

In addition, the plurality of suction holes of the conveyer belt is arranged so that the edge of the sheet in a sheet-width direction perpendicular to the transfer direction does not overlap with the suction holes. Accordingly, it is possible to reduce the amount of ink mist which may adhere to the edge of the sheet in the sheet-width direction. As a result, stain on the sheet can be further reduced.

What is claimed is:

1. An inkjet printing machine comprising:

a paper feeder configured to feed a sheet;

a conveyer having a belt with a plurality of suction holes disposed on the belt and configured to transfer the sheet fed by the paper feeder while sucking and holding the sheet on the belt by a suction force generated at the suction holes;

inkjet heads configured to discharge ink on the sheet being transferred by the conveyer; and a controller configured to perform printing by controlling the paper feeder to feed a sheet, controlling the conveyer to transfer the sheet, and controlling the inkjet heads to discharge the ink on the sheet, wherein the suction holes of the belt are arranged so that, when a leading edge of the sheet, in a transfer direction, does not intersect the suction holes, a trailing edge of the sheet also does not intersect the suction holes, and the controller controls the paper feeder based upon a detected position of a reference hole of the belt, to operate a feed roller so as to feed each sheet at a timing when the leading edge and the trailing edge of the sheet, in the transfer direction, do not intersect the suction holes.

2. The inkjet printing machine according to claim 1, wherein the suction holes of the belt are arranged so that an edge of the sheet in a sheet-width direction perpendicular to the transfer direction does not intersect the suction holes.

3. The inkjet printing machine according to claim 1, wherein the suction holes of the belt are of two different sizes.

4. The inkjet printing machine according to claim 1, wherein the suction holes adjacent to an edge of the sheet are smaller than other suction holes disposed on the belt.

* * * * *